United States Patent [19]

Pointon

[11] 3,964,593

[45] June 22, 1976

[54] KEYBOARDS

[75] Inventor: Peter Pointon, West Molesey, England

[73] Assignee: Alphameric Keyboards Limited, West Molesey, England

[22] Filed: Apr. 8, 1974

[21] Appl. No.: 459,233

[30] Foreign Application Priority Data

Apr. 9, 1973 United Kingdom ..... 16940/73

[52] U.S. Cl. ..... 197/98; 197/107; 200/159 B; 235/145 R; 340/365 E

[51] Int. Cl.[2] ..... B41J 5/08; B41J 5/18; B41J 5/26

[58] Field of Search ..... 197/17, 33, 98, 107; 200/5 R, 159 R, 159 A, 159 B; 235/145 R, 146; 340/365 R, 365 C, 365 P, 365 E

[56] References Cited

UNITED STATES PATENTS

| | | | |
|---|---|---|---|
| 2,945,111 | 7/1960 | McCormick | 200/153 J |
| 3,165,611 | 1/1965 | Hagberg | 200/159 R |
| 3,668,356 | 6/1972 | Kekas | 200/159 B |
| 3,710,209 | 1/1973 | Webb et al. | 340/365 C |
| 3,767,022 | 10/1973 | Olson | 200/159 R |
| 3,783,205 | 1/1974 | Boulanger | 200/159 B X |
| 3,797,630 | 3/1974 | Zilkha | 197/98 |
| 3,822,776 | 7/1974 | Pratt | 197/98 X |

OTHER PUBLICATIONS

IBM Tech Disclosure Bulletin, vol. 13, No. 7, pp. 12–70, "Push Button Actuator", Jarvis et al.

*Primary Examiner*—Edgar S. Burr
*Assistant Examiner*—R. E. Suter
*Attorney, Agent, or Firm*—Cushman, Darby & Cushman

[57] ABSTRACT

A key for an electronic keyboard comprises a plunger in a body which is mounted on the keyboard chassis and striker, with a helical spring within the plunger for engaging the striker. To provide required tactile characteristics, a further spring means, e.g., a bowed diaphragm, is arranged between the plunger and the striker and also a snap-action spring is arranged between the plunger and the body.

13 Claims, 7 Drawing Figures

KEYBOARDS

BACKGROUND OF THE INVENTION

1. Field of the Invention

This invention relates to keyboards for providing an electrical output signal on depression of a key and to keys for use therein. Many forms of keyboard are used or have been proposed for providing electrical outputs corresponding to the keys which have been operated. The electrical signal output may be provided, for example, by direct mechanical operation of contacts in an electrical circuit or by changing the inductance or capacitance in an electrical circuit or by use of magnetically operated devices, e.g., reed switches or Hall effect devices.

2. Prior Art

It is generally considered desirable to provide a mechanically movable key member having an appropriate tactile characteristic, that is to say appropriate feel as it is pressed, so that the operator can move the keys and knows instinctively from the fuel that the key has been properly operated. It is commonly required, with keys providing an electrical output, that a striker, e.g., a contact member should meet an abutment, e.g., a contact or contacts, but that further depression of the key, known as overtravel can then occur.

Usually overtravel is permitted by means of a relatively soft spring which permits the key top to continue movement after a striker or plunger at the bottom of the key has come in contact with a co-operating element to effect the necessary circuit operation. Thus such overtravel may be provided by a soft spring or resilient member arranged between the key top and a plunger carrying the striker or between the plunger and the striker.

SUMMARY OF THE INVENTION

It may in some cases be required that, as the key is depressed, resistance to motion should increase gradually and, at some point in the depression travel, the resistance should suddenly decrease and then gradually build up again as the key is further depressed. It will be appreciated that this tactile characteristic, which is known as negative tactile feel, gives a very definite and clear indication to the operator that the key has been appropriately moved. The actual circuit operation occurs at some point in the depression stroke which must be at or before the point of minimum resistance to motion. Preferably it is before the resistance to motion decreases.

On the other hand, it is in some cases preferred that, as the key is depressed, resistance to motion should increase gradually and, at some point in the depression travel, there should be a sharp increase in the force required, after which there is gradual increase with further depression of the key. This characteristic, which is known as positive tactile feel, also gives a very definite and clear indication to the operator that the key has been appropriately moved. The actual circuit operation is made to occur at or just before the point where resistance to motion sharply increases.

It is one of the objects of the present invention to provide an improved form of key construction which readily permits of meeting required tactile characteristics.

According to the present invention, a key for an electronic keyboard comprises a key top on a plunger slidable in a body with a helical spring in said body opposing depression movement of the plunger, a striker mounted on a stem movable within said body, the stem being at least partially within said helical spring and resilient means connecting said plunger and said stem, which resilient means are located within the helical spring and permit of overtravel of the plunger after the striker has contacted an abutment.

The resilient means conveniently comprises a resilient diaphragm, typically of plastics material or metal, arranged in the annular region between the stem and a dependent flange on the plunger inside the helical spring. The diaphragm may typically have inner and outer annular or part annular portions engaging respectively the stem and plunger and joined by two or more resilient links. Such a diaphragm may be substantially flat when in the unstressed condition but will permit of relative movement between the plunger and stem and thus forms a resilient member permitting of overtravel yet not taking up any substantial depth for the key construction as a whole. It is merely necessary to leave between the plunger and the top of the stem a gap sufficient to permit the required overtravel. It will be apparent however that various other forms of resilient coupling between the stem and plunger may readily be employed and can be arranged inside the aforementioned helical spring.

Preferably the aforementioned dependent flange on the plunger is arranged to form, with the body of the key, a locating means for locating the top of the helical spring and holding it in position. The bottom end of the helical spring conveniently is arranged to bear against a chassis in which the key is located.

The aforementioned body portion conveniently comprises a housing extending around the aforementioned spring and plunger and partially closed at its lower end to form a base on which the spring seats, said housing having a flange or other seating portion to seat on a chassis with resilient projecting means extending downwardly for forcing into an aperture in the chassis, said resilient means being shaped to engage on the underside of the chassis when the key is located with the projecting means in the aperture.

To provide an operating characteristic giving positive tactile feel, the aforementioned resilient means may be pretensioned, e.g., with a diaphragm as resilient means, by bowing the diaphragm. Thus, before overtravel can occur after the striker has contacted an abutment, the diaphragm has to be flattened, in other words, this pretension force has to be overcome. The effect is analogous to pulling the striker via a pretensioned spring (e.g., a coil spring); until the pull exceeds the pretension, no movement of the striker can be effected but thereafter the characteristic depends on the spring rate. Preferably the helical spring is precompressed in such an arrangement.

In order to provide a negative tactile feel characteristic in which the resistance to the motion of the key suddenly decreases at a point in the travel thereof, an annular groove may be provided in the plunger, conveniently in a stem portion of the plunger above the top of the spring and a member having one or more resilient radial arms may be provided extending around the plunger with the arms arranged to engage in said groove, the arms and/or the groove being of rounded form so that, on depression of the plunger, the arms will deflect as the groove is moved downwardly but will eventually move out of the groove thereby reducing the resistance to plunger movement.

Latching means operated by a face plate cam may be provided for latching the key in a depressed position, the cam being arranged so that the next depression stroke releases the key. The face plate cam and cam follower may be similar to the type used in ball point pens for latching and releasing the writing tip.

DESCRIPTION OF THE PREFERRED EMBODIMENT

Figure 1:
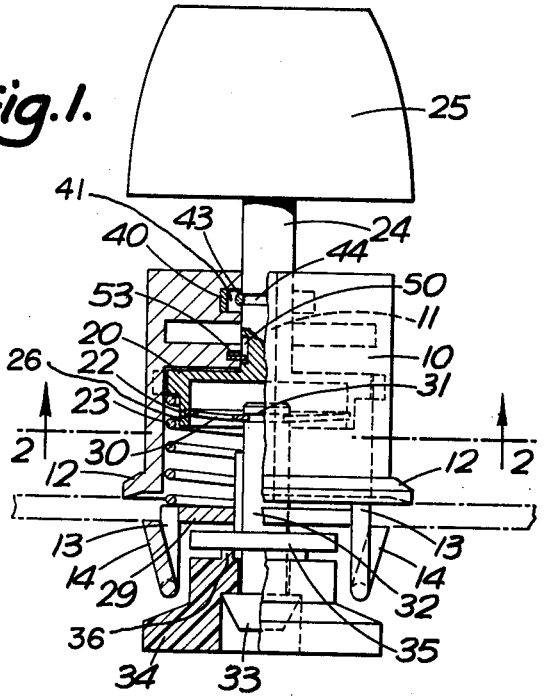
FIG. 1 is a vertical partial section through a key.
Figure 2:
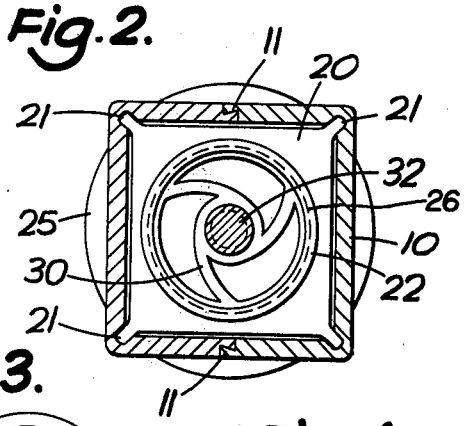
FIG. 2 is a section along the line 2—2 of FIG. 1 through the body portion of the key showing the plunger but with other components outlined for clarity.

Referring to FIG. 1, the key has a body portion 10 formed of moulded plastics material and of generally square section in a horizontal plane as seen in FIG. 2. This body portion is formed in two halves divided in a vertical plane, the two halves being arranged with overlapping edge portions as indicated at 11 so that the edge of one half snaps resiliently into the other half. At the bottom there is a slightly downwardly sloping flange 12 and, depending from this flange near the corners, are four downwardly extruding projections 13. On each half of the body, between the two projections, is a flap 14, the flap and projections being integral with the body half. The flap is joined to the projections at its two bottom corners and thus is resiliently hinged. This body portion is fitted into an aperture in a chassis, typically a sheet metal chassis (part of which chassis is shown in chain lines in FIG. 1), by forcing the flaps 14 and projections 13 into the aperture so that the flaps 14 bend inwardly and spring out underneath the chassis around the periphery of the aperture. The slight slope of the flange enables a very tight seal to be obtained between the body and the upper surface of the chassis to prevent ingress through the aperture of any liquid split on the keyboard.

Within the body portion 10 is a plunger 20 of generally square form. As shown in FIG. 2, the body portion has arcuate recesses 21 in its four corners and these recesses form bearings for the plunger which is correspondingly shaped at the corners. Along the side edges of the plunger 20, clearance is allowed between the plunger 20 and body 10 to permit air to pass freely during movement of the plunger thereby preventing any air pumping action on depression of a key. The square section of the plunger prevents rotation of the plunger in the key body. The plunger has a dependent circular portion 22 which forms, with the top of the plunger and the inner wall surface of the body 10, locating means for the top portion of a helical spring 23, the bottom of which seats on a base portion 29 integral with the body and joined to the projection 13. The spring thus provides tension for the flaps 14 which seat on the underside of the chassis.

The top of the plunger extends completely across the inside of the body and has an upwardly extending cylindrical stem 24 which carries a key top 25 bearing an alphanumerical or other character. The key top may be formed as a two-shot moulding or with a transparent cover over a character bearing element. Preferably the top of the stem has a projecting portion sloping at a small angle, e.g., 6°, to the axis of the stem and the key top has a correspondingly sloping recess, the key top resiliently engaging the projecting portion. With this construction, by turning the key top through 180°, it can be fitted on the plunger stem with the normal to the top surface of the key top sloping at twice said angle, e.g., 12°, to the axis of the plunger. This arrangement is employed so that the keys can be used on a sloping face keyboard. Such keyboards generally have a slope of 12° to 13°. The keys are mounted with the plunger axis at this angle to the vertical but with the key tops horizontal, each successive row of keys having their tops at successively increasing heights above the horizontal. Thus one key construction can be used to provide keys for keyboards of this nature or for keyboards where all the key tops are in a common plane, either horizontal or sloping.

Figure 5:
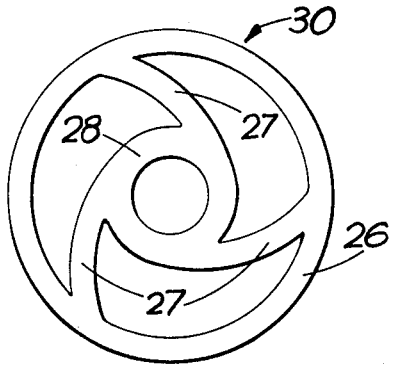
FIGS. 5 and 6 are respectively a plan view and elevation of a resilient diaphragm.
Figure 6:
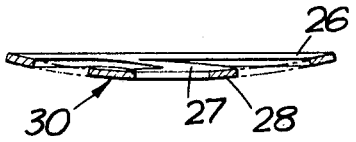

In the dependent circular portion 22 is carried an outer annular portion 26 of a resilient diaphragm 30 of plastics material or metal which is shown in FIGS. 5 and 6 and which has two or more radial arms 27 joined to an inner annular portion 28 which is a snap fit in a peripheral groove 31 at the top of a stem 32 of a striker assembly. The arms 27 of the diaphragm 30 need not be radial so long as they connect the inner and outer annular portions of the diaphragm and, to obtain the required "spring softness" it may be preferred to make each arm of spiral form. For reasons to be described later, in some cases the diaphragm may be bowed as shown in FIG. 6.

The stem 32 of the striker assembly has a key engaging a keyway in the base 29 to prevent rotation of the striker.

The stem 32 also carries, at its lower end, a head 33 which is forced through an aperture in an elastomeric element 34 which is thus gripped between the head and a plate 35 on the stem 32. The elastomeric element 34 has an upwardly extending lip 36 on its upper surface to bear against the plate 35. This elastomeric element 34, which forms a striker, may be conductive or may carry a metal plate or a metal/plastics laminate secured by adhesive to the elastomer so as to provide capacitive or conductive coupling between contact areas on a printed circuit board (not shown) held beneath the chassis. The peripheral lip 36 is located inwardly of the periphery of the element 34 to allow this element to rock slightly on its mounting. This ensures that the elastomeric element on the conductor assembly carried thereby comes into intimate contact with the printed circuit board or with a dielectric film over that board.

With the construction thus far described, when the key top is depressed, the plunger moves down against the force of spring 23 giving a gradually increasing resistance to motion. The striker moves with the plunger during this part of the key depression. When the striker comes in contact with the printed circuit board, no further movement of the striker stem is possible except for that permitted by the resilience of the element 34. However, overtravel, that is continued movement of the key top and plunger is possible by resilient deflection of the diaphragm 30. There must be a clearance between the top of the stem 32 and the top of the plunger to permit this overtravel. An alternative way of providing for overtravel would be by using, instead of the diaphragm 30, a helical spring between the top of the stem 32 and the top of the plunger; a further cylindrical dependent flange may be provided on the plunger to locate such a spring.

Figure 7:
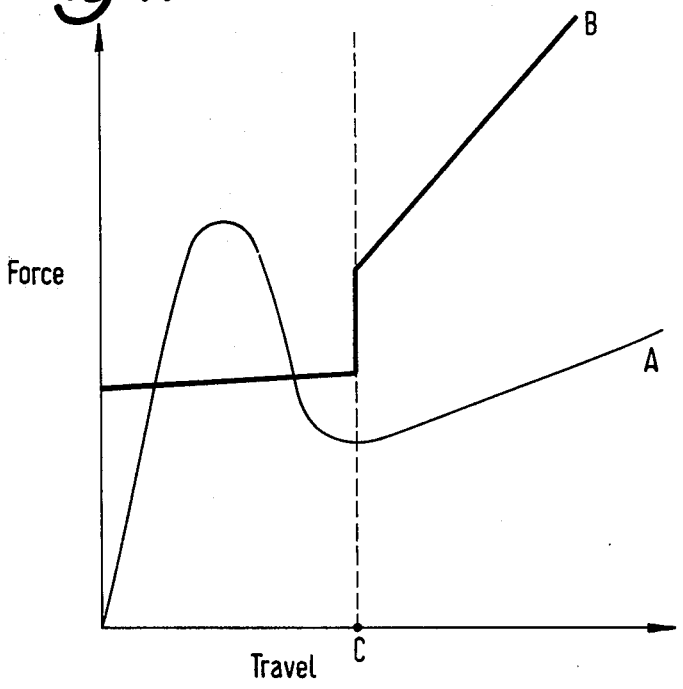
FIG. 7 is a graphical diagram illustrating two different tactile characteristics.

FIG. 7 is a graphical diagram illustrating two possible tactile feel characteristics. Curve A shows a negative tactile feel in which the resistance to motion of the key firstly increases linearly but, after a limited travel, decreases and subsequently increases. The contact operating point is made to occur before the point at which the resistance to motion decreases or, at least, not later than the point of minimum resistance indicated at C. The operator thus gets a distinct indication of sufficient movement of the key but overtravel beyond this point is possible against a gradually increasing resistance. Curve B shows positive tactile feel in which, at one point in the movement, there is a sudden increase in resistance with negligible travel of the key, overtravel beyond this point being possible against a gradually increasing resistance. The contact operating point is made at or before this sudden increase of resistance.

Figure 3:
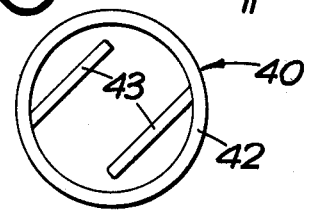
FIG. 3 is a plan view, to an enlarged scale compared with FIG. 1, of a resilient element.

If negative tactile feel is required, the diaphragm 30 is preferably flat and a resilient element 40, shown in plan view in FIG. 3, is fitted into a groove 41 in the top of the body 10 before the tow body halves are assembled together. This element 40 has an annular portion 42 located in the groove 41 and two arms 43 which are of circular cross-section and which, when the key is not depressed, locate in a rounded groove 44 extending around the stem 24 of the plunger. As the key top is depressed, these arms 43 deflect, thereby giving a gradually increasing resistance to movement which is additional to that of spring 23. At some point in the depression stroke however, the arms 43 will have deflected sufficiently that they leave the groove 44 and there is thus a sudden decrease in the resistance to motion of the key. The arms 43 will re-enter the groove 44 when the key is released and has returned to its normal, undepressed position. The element 40 thus forms a snap-action device which operates suddenly at a predetermined point in the stroke to decrease resistance to movement of the key.

To obtain a positive tactile feel, the element 40 is omitted and the diaphragm 30 is bowed, as shown in FIG. 6 so as to have a pre-tension. After the striker hits the printed circuit board, this pre-tension has to be overcome before further movement occurs, thereby requiring the sudden increase in applied force as shown in curve B in FIG. 7. In curve B, the initial force required is above zero; to obtain this the helical spring 23 has an initial compression.

Figure 4:
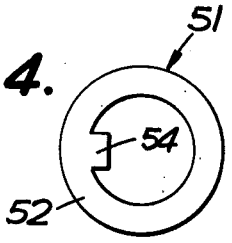
FIG. 4 is a cam follower.

It is sometimes required to latch a key in a depressed position; for example a shift key often has to be latched. This is provided, if required, by using a face plate cam 50 and a cam follower 51 which operate in similar manner to the latching means used in some constructions of ball point pen. The cam follower is shown in plan view in FIG. 4 and comprises a ring 52 which is a loose fit in a groove 53 in an inwardly extending portion of the body 10 surrounding the stem 24. The ring 52 fits loosely around the stem 24 but has a cam follower projection 54 which engages the face plate cam 50 which is shaped so that a first depression of the key causes the cam follower to rotate to a position where the cam, when the key is released, latches under the follower. The next depression of the key however, causes further rotation of the cam follower to release the key and, on upward travel of the key, to move the cam follower back to its initial position. It will be noted that this latching device is very simple in construction and takes up very little space in the key assembly.

I claim:

1. A key for an electronic keyboard comprising a body, an abutment fixed with respect to said body, a plunger slidable in said body, a helical spring in said body acting between said body and said plunger to oppose depression movement of the plunger, a dependent flange on said plunger inside said helical spring, a key top on said plunger, striker stem movable within said body, a striker mounted on said stem, the stem being at least partially within said helical spring, and resilient means comprising a resilient diaphragm connecting said plunger and said stem, which diaphragm is located within the helical spring and mounted in the annular region between the stem and the dependent flange, the resilient means permitting overtravel of the plunger against the resistance of said resilient means after the further movement of the striker has been inhibited by contact with said abutment.

2. A key as claimed in claim 1 wherein said diaphragm is formed of plastics material.

3. A key as claimed in claim 1 wherein said diaphragm is formed of metal.

4. A key as claimed in claim 1 wherein the diaphragm has inner and outer portions, each portion being at least partly annular, said inner and outer portions engaging respectively the stem and plunger; said diaphragm further having at least two resilient links joining said inner and outer portions, and wherein there is a gap between the plunger and the stem to permit overtravel.

5. A key as claimed in claim 1 wherein the diaphragm is substantially flat when the striker is out of contact with said abutment.

6. A key as claimed in claim 1 wherein the diaphragm is bowed when the striker is out of contact with said abutment.

7. A key as claimed in claim 1 wherein a snap-action device is provided engaging between said plunger and said body to resist relative movement therebetween until a predetermined extent of movement has occurred, said snap-action then operating to decrease resistance to movement.

8. A key as claimed in claim 1 wherein latching means comprising a face plate cam on said plunger and a cam follower are provided for latching the key in a depressed position, the cam and the cam follower being cooperatively shaped to engage on upward movement of the key with relative rotational displacement and to limit upward travel on alternate key operations whereby the key is latched down on one depression stroke and the next depression stroke releases the key.

9. A key as claimed in claim 1 and having a base plate formed integrally with said body and wherein the lower end of said helical spring bears against said base plate.

10. A key as claimed in claim 1 wherein said body is provided with at least three internal longitudinal guides and wherein said plunger is shaped to have co-operating elements slidably engaging said longitudinal guides.

11. A key for an electronic keyboard comprising a hollow body having an integral apertured base and resilient elements extending downwardly from said base with at least two outwardly extending portions, an abutment fixed with respect to said base a plunger slidable in said body, a helical spring within said plunger in said body and acting between said base and said plunger, to oppose depression of said plunger, a striker having a stem and slidable in said body, a gap being provided between the plunger and the stem and the stem being at least partially within said helical spring, and a resilient annular diaphragm, the outer periphery of the diaphragm engaging said plunger and the inner periphery engaging said stem, said resilient diaphragm permitting overtravel of the plunger after further movement of the striker has been inhibited by contact with said abutment.

12. A key for an electronic keyboard comprising a body, an abutment fixed with respect to said body, a plunger slidable in said body, a helical spring in said body acting between said body and said plunger to oppose depression movement of the plunger, a key top on said plunger, a striker stem movable within the body, a striker mounted on said stem, the stem being at least partially within said helical spring, resilient means connecting said plunger and said stem which resilient means are located within the helical spring and permit overtravel of the plunger against the resistance of said resilient means after the further movement of the striker has been inhibited by contact with said abutment, and a snap-action device engaging between said plunger and said body to resist relative movement therebetween until a predetermined extent of movement has occurred, said snapaction device then operating to decrease resistance to movement, which snap-action device comprises an annular groove in the plunger above the top of the spring, and a member having at least one resilient radial arm, said member being retained in said body and extending around the plunger with the arm engaging in said groove so that, on depression of the plunger, the arm will deflect as the groove is moved downwardly but will eventually move out of the groove thereby decreasing resistance to plunger movement.

13. A key for an electronic keyboard comprising a body, an abutment fixed with respect to said body, a plunger slidable in said body, a helical spring in said body acting between said body and said plunger to oppose depression movement of the plunger, a key top on said plunger, a striker stem movable within said body, a striker mounted on said stem, the stem being at least partially within said helical spring, resilient means connecting said plunger and said stem, which resilient means are located within the helical spring and permit overtravel of the plunger against the resistance of said resilient means after the further movement of the striker has been inhibited by contact with said abutment, and latching means for latching the key in a depressed position, which latching means comprise a face plate cam on said plunger and an annular cam follower around said plunger, said cam follower loosely fitting in an annular, inwardly facing groove on said body and having an inwardly extending projection engaging said cam, the cam and cam follower being cooperatively shaped to engage on upward movement of the key with relative rotational displacement and to limit upward travel on alternate key operations whereby the key is latched down on one depression stroke and the next depression stroke releases the key.

* * * * *